United States Patent [19]

McCord

[11] 4,034,174

[45] July 5, 1977

[54] WIND WARNING DEVICE

[76] Inventor: Talmadge W. McCord, Mountain Crest, Guntersville, Ala. 35976

[22] Filed: June 2, 1975

[21] Appl. No.: 582,697

[52] U.S. Cl. ..... 200/81.9 R; 73/228; 340/241; 200/331

[51] Int. Cl.² ..... H01H 35/40

[58] Field of Search ..... 290/44; 200/81.9 R, 200/81 R, 153 T, 330, 331, 338; 73/228; 340/239 R, 241

[56] References Cited

UNITED STATES PATENTS

| | | | |
|---|---|---|---|
| 859,147 | 6/1900 | Strodtbeck | 200/81.9 R |
| 1,814,235 | 7/1931 | Trogner | 200/81.9 R |
| 3,162,847 | 12/1964 | Huffman | 200/81.9 R |
| 3,445,614 | 5/1969 | Switzer | 200/81.9 R |

*Primary Examiner*—Gerald P. Tolin
*Attorney, Agent, or Firm*—Bacon & Thomas

[57] ABSTRACT

A wind warning device, comprising a wind tube and wind vane, includes a disc connected to a switch by a spring. The spring and disc are set to actuate the switch when wind velocity exceeds a threshold value. The switch may be used in an alarm circuit to activate a warning device indicating the occurrence of excessive wind velocity.

10 Claims, 4 Drawing Figures

WIND WARNING DEVICE

BACKGROUND OF THE INVENTION

1. Field of the Invention

The invention relates to wind-actuated devices, and more particularly to devices for providing a warning when the velocity of a wind exceeds a particular value which is known to be potentially hazardous.

2. Description of the Prior Art

The prior art (e.g., U.S. Pat. Nos. 691,082 and 2,438,674) teaches the measurement of wind velocity by noting the rate at which a switch opens and closes. In addition, it is also known that a switch may be opened or closed by a wind having a velocity greater than a threshold value, as shown in U.S. Pat. No. 3,534,191.

A problem with prior art devices as shown, for example, in U.S. Pat. No. 3,534,191 is that different wind directions cause different contact points to be used to complete a circuit. Further, a pendulum-like ball swings in different directions in response to varying wind directions. As a result, a mechanical binding in one part of a ball joint used to suspend such a pendulum, or a resistive build up or warping of one area of the circular contacts used in such a device, can lead to erroneous results for one wind direction even when the device is accurately calibrated for other directions.

SUMMARY OF THE INVENTION

The instant invention provides a wind-velocity warning device having a means for directing the device to receive a wind of any direction and to provide warning when the wind velocity exceeds a particular value.

A primary object of the invention is to provide an accurate wind-warning device overcoming the disadvantages of the prior art devices.

An additional object of this invention is to provide a wind warning device having an electrical switch therein, and providing a means for pointing the switch in the proper direction for making an accurate determination of wind-velocity.

It is a further object of the invention to provide means for preventing the entanglement of wires around portions of the device.

Yet another object of the invention is to provide a wind warning device capable of being set to warn of winds having a velocity exceeding a variable threshold.

The device of the invention overcomes the disadvantages of the prior art by providing a rotatable wind tube, including therein a disc for responding to wind passing through the tube. A spring biases the disc to respond only to winds of sufficiently high velocity as to be able to overcome the spring force and cause the disc to move, thereby actuating a switch.

The rotating tube presents the disc and switch to winds from any direction. Calibration of the device, performed for a single wind direction, is thus accurate for all wind directions.

Moreover, the disc and switch, being within the tube, are protected from the effects of inclement weather.

BRIEF DESCRIPTION OF THE DRAWINGS

Other objects and features of the invention will become clear from the detailed description thereof, which is intended merely to represent one embodiment and not in any way to limit the scope of the invention thereto, wherein.

DETAILED DESCRIPTION OF THE INVENTION

Figure 1:
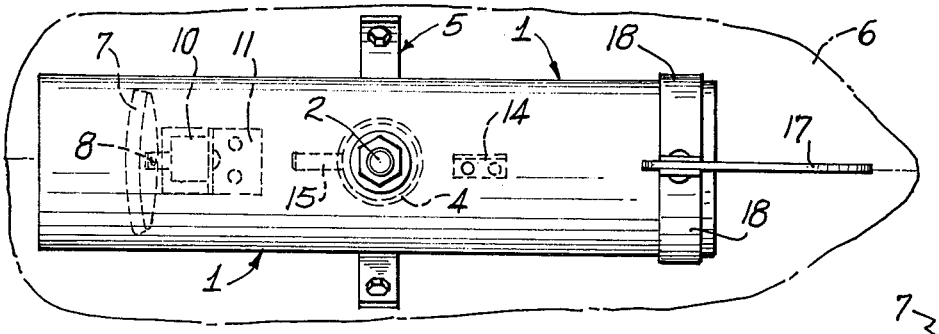
FIG. 1 is a plan view of the wind warning device of the present invention.
Figure 2:
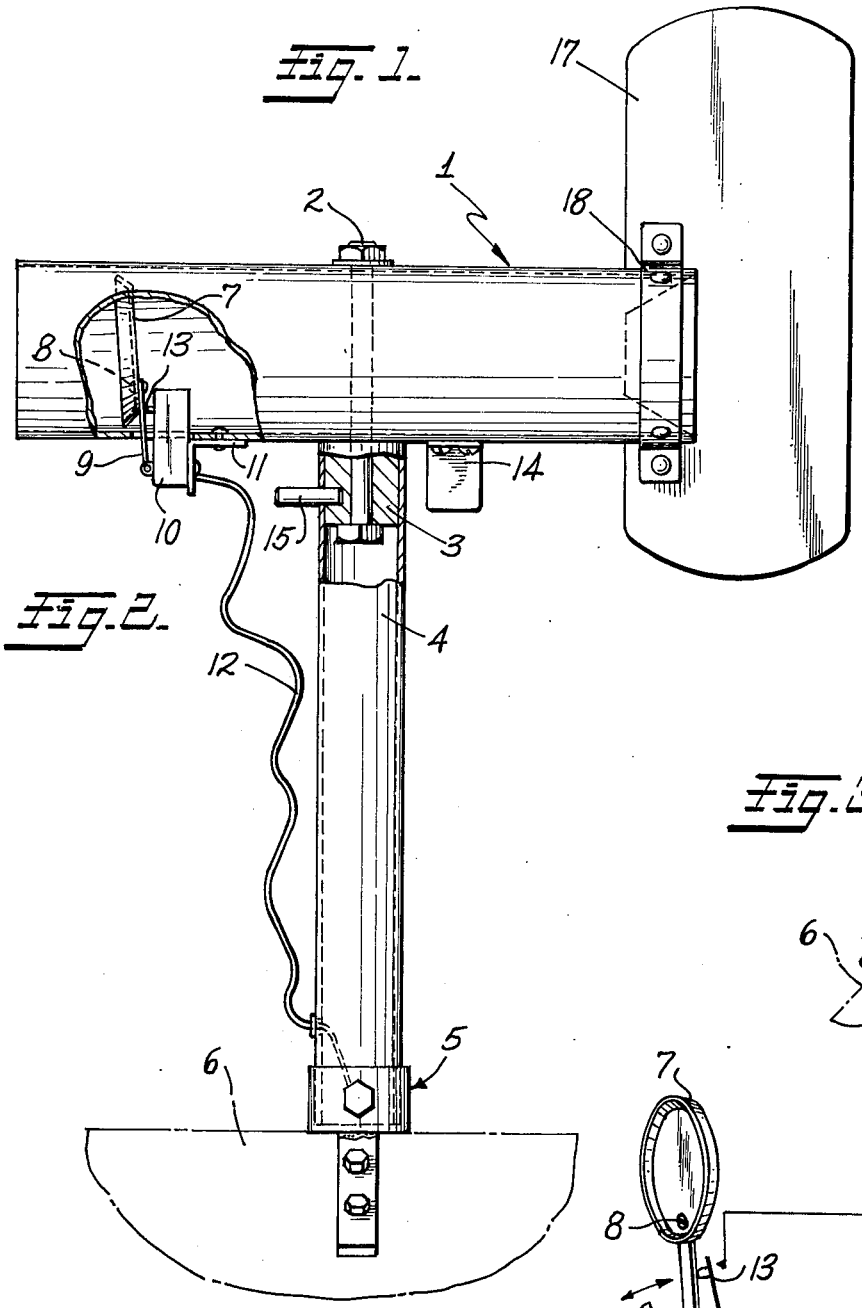
FIG. 2 is an elevation view, partly in section, of the device in FIG. 1.
Figure 3:
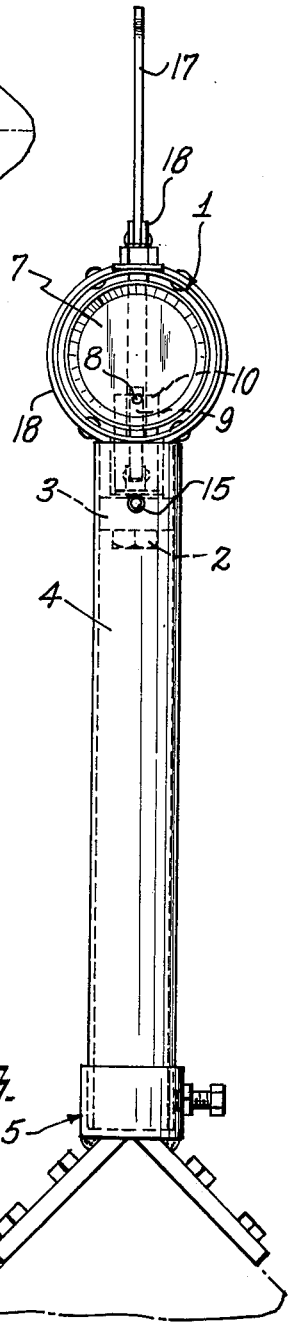
FIG. 3 is an end elevational view of the device of FIG. 2 as viewed from the left thereof.

Referring to FIGS. 1 and 2, a wind tube 1 is rotatably secured by a bolt 2 to a bushing 3 in a standpipe 4. The standpipe is mounted by means of a roof mount 5 to a roof 6 of a building.

Figure 4:
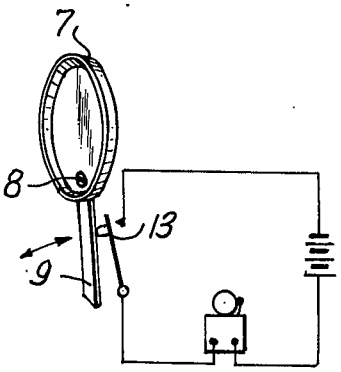
FIG. 4 shows a circuit diagram of a circuit activated by the device of the present invention.

Within wind tube 1 is a flared aluminum disc 7 attached, for example, by a bolt and nut assembly 8 to a leaf spring switch actuator 9. Spring 9 is connected to a switch housing 10, which is mounted by a bracket 11 to the wind tube. A wire 12 leads from a switch 13 in housing 10 to the alarm circuit shown in FIG. 4.

A wind vane 17 is mounted on tube 1 by clamp 18.

A stop bracket 14 is riveted to wind tube 1, and a cooperating stop 15 is mounted on the standpipe. The stop 15 is preferably a split pin penetrating standpipe 4 and bushing 3.

In operation, wind will cause the wind tube to point in the wind's direction by action of wind vane 17. Rotation will be around an axis of rotation at the center of bolt 2. Disc 7 will thus face the wind directly, regardless of the wind's direction. The force of the wind acts on the disc tending to move it, and spring 9 provides a resisting force against such motion.

For any particular size of disc, a particular wind velocity will be needed to counteract the resistance of the spring. It is thus apparent that changing either the disc or the spring will change the wind velocity needed to move the disc and thus to actuate switch 13 within housing 10. Also, by bending spring 9, the actuating velocity can be varied.

In order to avoid the possibility of wire 12 becoming wrapped around standpipe 4, cooperating stops 14 and 15 are provided on the device. The wind tube is thus limited to a single rotation about its axis, and entanglements of wire 12 are thus avoided.

It is recognized that in a location where the prevailing winds are primarily from a single direction, stop 15 would be pointed in that direction thereby providing an accurate response to virtually any threatening wind. As an example, if the stop subtends an arc of 1° of rotation, winds from any direction within 179½° of the prevailing direction will lead to accurate responses.

It is further recognized that one or more slip rings may be used with this device and thus obviate the need for such a stop arrangement.

Having thus described the objects, operation and advantages of an embodiment of the invention, it will be obvious to those skilled in the art that various modifications and changes may be made thereto. The scope of the invention as defined by the appended claims is not limited to the above described embodiment, and includes the modifications thereof.

I claim:

1. A wind warning device comprising:

a. supporting means;

b. a wind tube rotatably mounted on said supporting means for the passage of wind therethrough;

c. means for directing said wind tube to receive wind of any direction;

d. means within said wind tube for responding to said wind;

e. means for resiliently biasing said responding means to a first position, and f. switching means connected to said responding means for changing a circuit condition in response to motion of said responding means away from said first position, whereby any wind providing sufficient force within said wind tube to displace said responding means by overcoming bias provided by said resilient biasing means causes said switching means to change said circuit condition.

2. A wind warning device as defined in claim 1 further including means for limiting the rotation of said wind tube about said supporting means thereby preventing harmful tension from being applied to wires electrically connected to said switching means.

3. A wind warning device as defined in claim 2 wherein said limiting means includes: a first member mounted on said supporting means and a second member mounted on said wind tube for contacting said first member when said wind tube is rotated to a predetermined angular displacement with respect to said support means, whereby said wind tube is prevented from rotation exceeding said predetermined angular displacement.

4. A wind warning device as defined in claim 3 wherein said supporting means is mounted on a structure by a mounting means.

5. A wind warning device as defined in claim 1 wherein said resilient biasing means comprises a spring connecting said switching means and said responding means, and wherein said spring is affixed to said wind tube and rotates therewith.

6. A wind warning device as defined in claim 1 wherein said responding means comprises a disc.

7. A wind warning device as defined in claim 1 wherein said circuit is connected to an alarm.

8. A wind warning device as defined in claim 5 wherein said spring comprises a leaf spring.

9. A wind warning device as defined in claim 5 wherein said spring is replaceably connected to said responding means and to said switch means, thereby providing for simple replacement of said spring by springs of different mechanical properties, whereby said wind warning device provides a warning when wind velocity exceeds a variable threshold value.

10. A wind warning device as defined in claim 6 wherein said disc is replaceably connected to said resilient biasing means, thereby providing for simple replacement of said disc by discs of different physical characteristics, whereby said wind warning device provides a warning when wind velocity exceeds a variable threshold value.

* * * * *